US012152818B2

(12) United States Patent
Smith

(10) Patent No.: US 12,152,818 B2
(45) Date of Patent: Nov. 26, 2024

(54) METHOD AND SYSTEM FOR OPERATING A REFRIGERATION SYSTEM

(71) Applicant: C. NELSON MFG., Oak Harbor, OH (US)

(72) Inventor: Kellen R. Smith, Port Clinton, OH (US)

(73) Assignee: C. NELSON MFG., Oak Harbor, OH (US)

( * ) Notice: Subject to any disclaimer, the term of this patent is extended or adjusted under 35 U.S.C. 154(b) by 354 days.

(21) Appl. No.: 17/678,343

(22) Filed: Feb. 23, 2022

(65) Prior Publication Data

US 2022/0268502 A1 Aug. 25, 2022

Related U.S. Application Data

(60) Provisional application No. 63/153,084, filed on Feb. 24, 2021.

(51) Int. Cl.
*F25B 47/02* (2006.01)
*F25B 7/00* (2006.01)

(52) U.S. Cl.
CPC ..... *F25B 47/022* (2013.01); *F25B 7/00* (2013.01); *F25B 2313/027* (2013.01); *F25B 2347/021* (2013.01); *F25B 2700/11* (2013.01)

(58) Field of Classification Search
CPC .... F25B 47/022; F25B 7/00; F25B 2313/027; F25B 2313/0211; F25B 2313/02322; F25B 2313/02332; F25B 2313/0251; F25B 2313/02522; F25B 2313/02532; F25B 2347/021; F25B 2347/02; F25B 2700/11
See application file for complete search history.

(56) References Cited

U.S. PATENT DOCUMENTS

| | | | |
|---|---|---|---|
| 2,954,680 | A | 10/1960 | Ruff |
| 3,464,226 | A | 9/1969 | Kramer |
| 3,677,025 | A | 7/1972 | Payne |
| 3,740,965 | A | 1/1973 | Kogel et al. |
| 3,933,004 | A | 1/1976 | Carter et al. |
| 4,012,921 | A | 3/1977 | Willitts et al. |
| 4,083,195 | A | 4/1978 | Kramer et al. |
| 4,151,723 | A | 5/1979 | Gardner |

(Continued)

FOREIGN PATENT DOCUMENTS

| | | | |
|---|---|---|---|
| AU | 2013101170 | A4 | 10/2013 |
| CN | 102538327 | A | 7/2012 |

(Continued)

OTHER PUBLICATIONS

English translation of O et al. (KR 20080097511 A) (Year: 2008).*

*Primary Examiner* — Miguel A Diaz
(74) *Attorney, Agent, or Firm* — Tucker Ellis LLP

(57) ABSTRACT

A refrigeration system includes a refrigerated cavity, a first compression system, and a second compression system. The refrigeration system further includes a controller configured to operate the refrigeration system in a first mode in which the first compression system and the second compression system operate to cool the refrigerated cavity. The refrigeration system is further configured to selectively operate the refrigeration system in a second mode in which a refrigerant discharged from the second compressor is routed through the first evaporator to defrost the first evaporator.

18 Claims, 6 Drawing Sheets

(56) References Cited

U.S. PATENT DOCUMENTS

| | | | | |
|---|---|---|---|---|
| 5,220,807 | A | 6/1993 | Bourne et al. | |
| 6,094,925 | A | 8/2000 | Arshansky et al. | |
| 2009/0223232 | A1 | 9/2009 | Rolfsman et al. | |
| 2010/0205984 | A1 | 8/2010 | Gu et al. | |
| 2013/0098078 | A1 | 4/2013 | Contreras Lafaire et al. | |
| 2013/0174589 | A1* | 7/2013 | Wightman | F25B 30/02 62/81 |
| 2014/0137580 | A1* | 5/2014 | Peyaud | F25B 41/20 62/151 |
| 2014/0352343 | A1 | 12/2014 | Hinde et al. | |
| 2015/0191182 | A1* | 7/2015 | Abou Eid | F25D 21/06 62/335 |
| 2017/0030627 | A1 | 2/2017 | Kim | |
| 2017/0038125 | A1 | 2/2017 | Tani et al. | |
| 2017/0176077 | A1* | 6/2017 | Knatt | F25C 1/25 |

FOREIGN PATENT DOCUMENTS

| | | | | |
|---|---|---|---|---|
| CN | 203518397 | U | 4/2014 | |
| DE | 10233411 | A1 | 2/2004 | |
| DE | 102014001929 | A1 | 8/2015 | |
| GB | 1405221 | A | 9/1975 | |
| JP | 11173710 | A2 | 7/1999 | |
| KR | 20080097511 | A * | 11/2008 | F25B 41/20 |
| KR | 100948584 | B1 | 3/2010 | |
| WO | 9420803 | A1 | 9/1994 | |
| WO | 2008108744 | A1 | 9/2008 | |
| WO | 2015131184 | A1 | 9/2015 | |

* cited by examiner

METHOD AND SYSTEM FOR OPERATING A REFRIGERATION SYSTEM

CROSS-REFERENCE TO RELATED APPLICATIONS

This application claims priority to and the benefit of U.S. Application Ser. No. 63/153,084 filed on Feb. 24, 2021, the entirety of which is incorporated herein by reference.

BACKGROUND

Technical Field

Embodiments of the subject matter disclosed herein relate to a refrigeration system that includes two compression systems that work together to maintain temperature within a refrigerated cavity while also defrosting evaporator coils.

Discussion of Art

A typical freezer with a low maintenance frost-free design includes a single system of a condenser, a compressor, and an evaporator coil. Over time during operation, frost can build up on the evaporator coil. The typical freezer uses an electric heater to defrost the evaporator coil. However, this method of defrosting the evaporator coil adds heat to the overall system and causes the compressor to work harder, and consume more energy, to maintain proper temperatures within the refrigerated cavity. The added heat is wasted energy that does nothing but defrost the coil.

BRIEF DESCRIPTION OF THE DRAWINGS

Reference is made to the accompanying drawings in which particular embodiments and further benefits of the invention are illustrated as described in more detail in the description below, in which.

DETAILED DESCRIPTION

Figure 1:
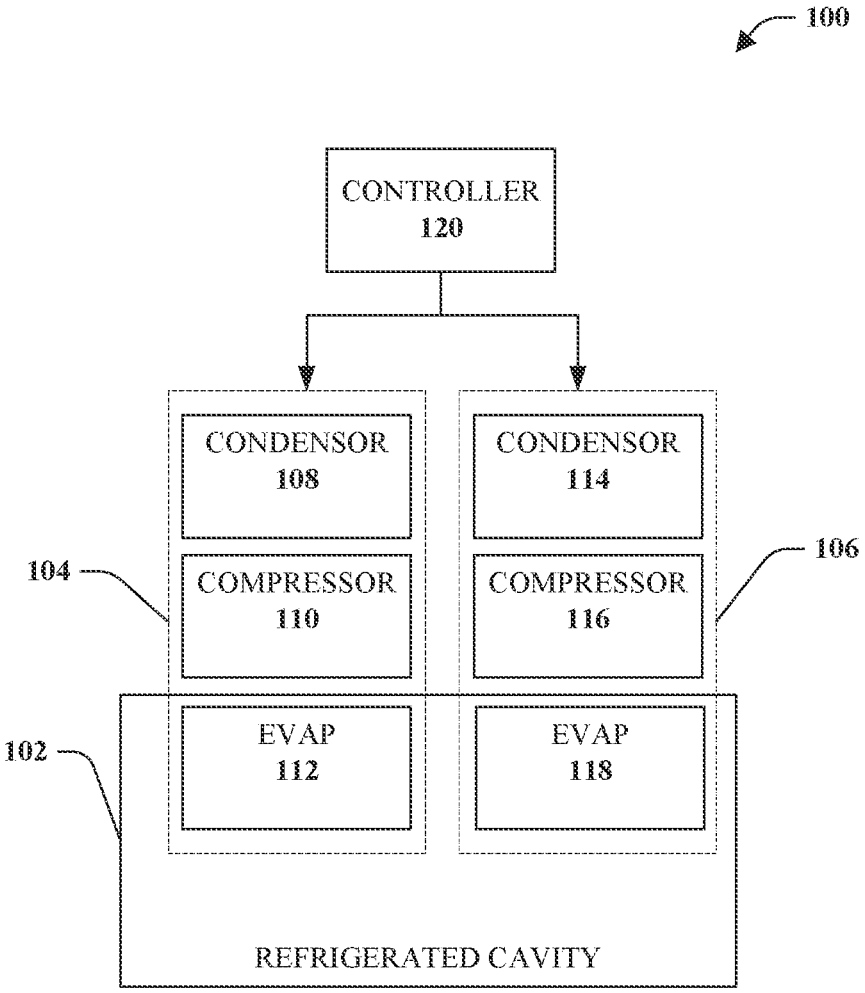
FIG. 1 is a schematic drawing of a refrigeration system.

Embodiments of the present invention relate to a refrigeration system that includes a refrigerated cavity and a first vapor compression system and a second vapor compression system, with each system containing a condenser, a compressor, and an evaporator. The refrigeration system can also include a controller, which can be configured to operate the refrigeration system in a first mode, in which the compressors are operated to cool the refrigerated cavity to an operating set point temperature. The controller can also be configured to operate the refrigeration system in a second mode (also known as defrost mode), in which one of the vapor compression systems is utilized to defrost the evaporator coil of the other vapor compression system. During the second mode, the controller can control a series of valves to direct the heated discharge gas of one vapor compression system's compressor into the evaporator of the other vapor compression system to defrost the evaporator coils. By way of example and not limitation, the first vapor compression system can be utilized to defrost the evaporator coil of the second vapor compression system by directing the heated discharge gas of the first vapor compression system's compressor into the evaporator of the second vapor compression system which, in turn, defrosts the evaporator coils of the second vapor compression system. In certain embodiments, the second vapor compression system can utilize a cold wall system such as eutectic plates or a copper cold wall to store cold energy while the second vapor compression system is defrosting the first vapor compression system's evaporator coil.

A further benefit of the refrigeration system with more than one vapor compression system is that it allows for the use of flammable refrigerants such as R-290 (propane) in higher quantities. R-290 can provide 10-40% improvement in energy efficiency in low temperature applications compared to other low-temperature refrigerants. For example, in the United States, there is a current charge limit of 150 grams per compression system for A3 refrigerants such as R-290 (Propane) and R-600a (Isobutane). The use of multiple vapor compression systems allows for the use of such refrigerants at higher amounts while staying within the regulation limits.

With reference to the drawings, like reference numerals designate identical or corresponding parts throughout the several views. However, the inclusion of like elements in different views does not mean a given embodiment necessarily includes such elements or that all embodiments of the invention include such elements.

The term "eutectic plate" refers to a device that can store heat or cold and can be referred to as a "holdover plate," a "hot plate" or a "cool plate." The eutectic plate can deliver the stored heat or cold to heat or cool a cavity. It should be appreciated that while "cold" is a lack or absence of thermal energy, the term "store cold" or similar terms may be used herein to describe making something cold (e.g. a cold wall system or eutectic plates) for the purpose of retaining the coldness for later use or transfer. Similarly, the term "cold energy" is used herein to refer to coldness that is capable of being retained and used or transferred at a later time.

The term "controller," as used herein can be defined as a portion of hardware, a portion of software, a portion of logic, or a combination thereof. A portion of hardware can include at least a processor and a portion of memory, wherein the memory includes an instruction to execute. The term "controller" can also refer to multiple hardware components that each function as a singular controller.

FIG. 1 illustrates a refrigeration system 100 that can include a refrigerated cavity 102. In certain embodiments, the refrigerated cavity 102 can utilize eutectic plates to store cold and release the cold into the refrigerated cavity 102 throughout a period of time. The refrigeration system 100 can further include a first compression system 104, and a second compression system 106, which both can be vapor-compression refrigeration systems (VCRS). The first compression system 104 can include a first condenser 108, a first compressor 110, and a first evaporator 112. The second compression system 106 can include a second condenser 114, a second compressor 116, and a second evaporator 118. By way of example and not limitation, the refrigeration system 100 can be a freezer, a cooler, a refrigerator, or a refrigerated vehicle, among others. It should be appreciated that there can be any number of vapor compression systems from 1 to x, where x is a positive integer.

Figure 2:
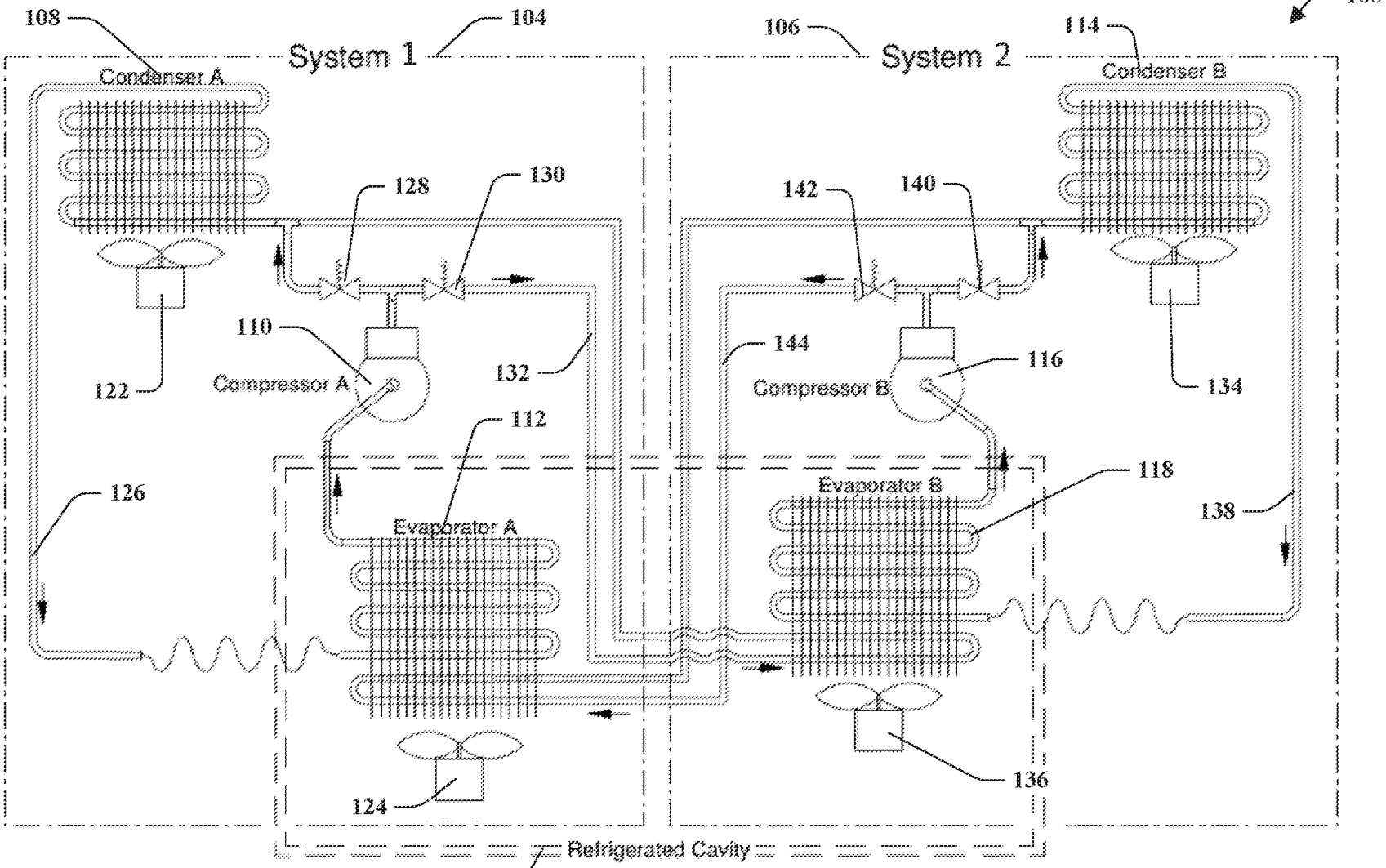
FIG. 2 is an illustration of the internal components of an exemplary refrigeration system.

The refrigeration system 100 can further include a controller 120. The controller can be any of a processor, microprocessor, or control circuitry, among others. The controller can be configured to activate or deactivate any of the first condenser 108, first compressor 110, first evaporator 112, second condenser 114, second compressor 116, second evaporator 118. The controller 120 can also be configured to operate one or more fans or valves along a refrigerant tubing circuit as shown in FIG. 2 and discussed in greater detail below. The controller can be configured to operate the refrigeration system 100 in a first mode where one or both of the first compression system 104 and the second compression system 106 are operated to cool the refrigerated cavity to a temperature set point. Further, the controller 120 can also be configured to operate the refrigeration system 100 in a second mode where one of the first or second compression system 104, 106, is operated to defrost coils of the evaporator of the other compression system 104, 106. The controller 120 can be further configured to switch the refrigeration system between the first mode and the second mode based upon a parameter. By way of example and not limitation, the parameter can be a period of time, a temperature of one or more of the evaporators, a detected presence of frost on one or more of the evaporators, or a detected temperature within the refrigerated cavity 102, among others.

Turning now to FIG. 2, internal components of the refrigeration system 100 are illustrated. The first compression system 104 can further include a first condenser fan 122 configured to blow air over the first condenser 108, and a first evaporator fan 124 configured to blow air over the first evaporator 112. Each of the first condenser 108, the first compressor 110, and the first evaporator 112 are interconnected with a first refrigerant tubing circuit 126 that is a closed system of tubing that contains a refrigerant such as R290 (propane), R510A, R600a (Isobutane), R134A, Freon, R22, and R32, among others. The first refrigerant tubing circuit 126 can be any type of piping or tubing capable of effectively carrying refrigerant through the compression system, as chosen using sound engineering judgment. In one embodiment, the first refrigerant tubing circuit 126 includes copper piping. In one embodiment, the first compression system 104 is charged with 150 grams of R290 propane. Downstream of the first compressor 110 is a first refrigerant valve 128, which, when open, provides a refrigerant flow path through the first refrigerant tubing circuit 126 from the first compressor 110 to the first condenser 108. Also downstream of the first compressor 110 is a first defrost valve 130, which, when open, provides a refrigerant flow path through a first defrost circuit 132 from the first compressor 110 to the second evaporator 118. The first defrost circuit 132 can be any type of piping or tubing capable of effectively carrying refrigerant through the compression system, as chosen using sound engineering judgment. In one embodiment, the first defrost circuit 132 includes copper piping. The first refrigerant valve 128 and the first defrost valve 130 are arranged at the outlet of the first compressor 110 such that when the first refrigerant valve 128 is open and the first defrost valve is closed 130, the refrigerant flows from the first compressor 110 through the first refrigerant tubing circuit 126, and when the first refrigerant valve 128 is closed and the first defrost valve 130 is open, the refrigerant flows from the first compressor 110 through the first defrost circuit 132 to defrost the second evaporator 118 as described below. It should be appreciated that the first refrigerant valve 128 and the first defrost valve 130 may be either a normally open valve or a normally closed valve as long as the controller is configured to operate the valves accordingly. It should also be appreciated that one or more one-way valves may be incorporated to prevent backflow of refrigerant from the first refrigerant tubing circuit 126 into the first defrost circuit 132 during the first mode.

Similar to the first compression system 104, the second compression system 106 can further include a second condenser fan 134 configured to blow air over the second condenser 114, and a second evaporator fan 136 configured to blow air over the second evaporator 118. In the refrigerated cavity, the two evaporators 112, 118, and their associated evaporator fans 124, 136 can be isolated from each other's air streams. Each of the second condenser 114, the second compressor 116, and the second evaporator 118 are interconnected with a second refrigerant tubing circuit 138 that is a closed system of tubing that contains a refrigerant such as R290 (propane), R510A, R600a (isobutene), R134A, Freon, R22, and R32, among others. The second refrigerant tubing circuit 138 can be any type of piping or tubing capable of effectively carrying refrigerant through the compression system, as chosen using sound engineering judgment. In one embodiment, the second refrigerant tubing circuit 138 includes copper piping. In one embodiment, the second compression system 106 is charged with 150 grams of R290 propane. Downstream of the second compressor 116 is a second refrigerant valve 140, which, when open, provides a refrigerant flow path through the second refrigerant tubing circuit 138 from the second compressor 116 to the second condenser 114. Also downstream of the second compressor 116 is a second defrost valve 142, which, when open, provides a refrigerant flow path through a second defrost circuit 144 from the second compressor 116 to the first evaporator 112. The second defrost circuit 144 can be any type of piping or tubing capable of effectively carrying refrigerant through the compression system, as chosen using sound engineering judgment. In one embodiment, the second defrost circuit 144 includes copper piping. The second refrigerant valve 140 and the second defrost valve 142 are arranged at the outlet of the second compressor 116 such that when the second refrigerant valve 140 is open and the second defrost valve is closed 142, the refrigerant flows from the second compressor 116 through the second refrigerant tubing circuit 138, and when the second refrigerant valve 140 is closed and the second defrost valve 142 is open, the refrigerant flows from the second compressor 116 through the second defrost circuit 144 to defrost the first evaporator 112 as described below. It should be appreciated that the second refrigerant valve 140 and the second defrost valve 142 may be either a normally open valve or a normally closed valve as long as the controller is configured to operate the valves accordingly. It should also be appreciated that one or more one-way valves may be incorporated to prevent backflow of refrigerant from the second refrigerant tubing circuit 138 into the second defrost circuit 144 during the first mode.

When the controller 120 operates the refrigeration system 100 in the first mode, and the controller 120 is configured to operate both the first compression system 104 and the second compression system 106, the controller 120 is configured to energize: the first compressor 110, the second compressor 116, the first condenser fan 122, the second condenser fan 134, the first evaporator fan 124, and the second evaporator fan 136. The controller 120 is further configured to open the first refrigerant valve 128 and the second refrigerant valve 140. For example, if the first refrigerant valve 128 and the second refrigerant valve 140 are both normally closed valves, the controller 120 is configured to energize both valves. It should be appreciated that in certain embodiments, the controller 120 may be configured to operate only one of the first compression system 104 or the second compression system 106 during the first mode. In such embodiments, the controller 120 is configured to operate the components accordingly.

In this first mode configuration, in the first compression system 104, the refrigerant flowing through the first evaporator 112 removes heat from the air within the refrigerated cavity 102. The refrigerant then continues through the first refrigerant tubing circuit 126 into the first compressor 110, which compresses the refrigerant into a heated compressed gas. The refrigerant (as a compressed gas) continues through the first refrigerant tubing circuit 126 to the first condenser 108, which dissipates heat from the refrigerant into air outside of the refrigerant cavity 102. The refrigerant continues to flow back into the first evaporator 112 where this cycle repeats for the duration of the first mode operation. Similarly, in the second compression system 106 (if also operating), the refrigerant flowing through the second evaporator 118 removes heat from the air within the refrigerated cavity 102. The refrigerant then continues through the second refrigerant tubing circuit 138 into the second compressor 116, which compresses the refrigerant into a heated compressed gas. The refrigerant (as a compressed gas) continues through the second refrigerant tubing circuit 138 to the second condenser 114, which dissipates heat from the refrigerant into air outside of the refrigerant cavity 102. The refrigerant continues to flow back into the second evaporator 118 where this cycle repeats for the duration of the first mode operation.

In the first mode, one or both of the first compression system 104 and the second compression system 106 are configured to run until a temperature sensor in the refrigerated cavity 102 detects that the operating setpoint has been reached. At this time, the first compression system 104 and the second compression system 106 can be de-energized. The refrigeration system 100 can enter into a second mode either at predetermined intervals or based on another parameter, including, but not limited to, a temperature provided by a sensor in the first evaporator 112 or the second evaporator 118 reaching a temperature setpoint that indicates the likely presence of ice or frost. Only one compression system can defrost at a time. The first compression system 104 and the second compression system 106 can alternate defrost cycles.

When the controller 120 operates the refrigeration system 100 in the second mode to defrost the first evaporator 112, the controller 120 is configured to: de-energize the first compressor 110, the first condenser fan 122, the first evaporator fan 124, and the second condenser fan 134; energize the second compressor 116, and the second evaporator fan 136; close the second refrigerant valve 140; and open the second defrost valve 142.

In this second mode configuration, in which the first evaporator 112 is defrosted, the second compression system 106 functions to defrost the first evaporator 112 while still cooling the refrigerated cavity 102. The refrigerant flows from the discharge of the second compressor 116 through the second defrost valve 142 and through the second defrost circuit 144. The refrigerant can be in the form of a heated gas. The refrigerant flows through the second defrost circuit 144, which is routed through the first evaporator 112. In this manner, the refrigerant, which can be a heated discharge gas discharged from the second compressor 116, is routed into the first evaporator 112, causing any accumulated frost or ice to melt and be drained away. The refrigerant then continues through the second defrost circuit 144 and into the second condenser 114, the second evaporator 118, and back into the second compressor 116 where the defrost cycle continues. The second mode can terminate based on a timed duration or based on a measured increase in the first evaporator's 112 temperature as measured by a sensor in the first evaporator 112. In certain embodiments, the controller 120 can be configured to switch the refrigeration system 100 back to the first mode. In other embodiments, the controller can be configured to arrange the refrigeration system 100 so that the second evaporator 118 is defrosted as described below.

When the controller 120 operates the refrigeration system 100 in the second mode to defrost the second evaporator 118, the controller 120 is configured to: de-energize the second compressor 116, the second condenser fan 134, the second evaporator fan 136, and the first condenser fan 122; energize the first compressor 110, and the first evaporator fan 124; close the first refrigerant valve 128; and open the first defrost valve 130.

In this second mode configuration, in which the second evaporator 118 is defrosted, the first compression system 104 functions to defrost the second evaporator 118 while still cooling the refrigerated cavity 102. The refrigerant flows from the discharge of the first compressor 110 through the first defrost valve 130 and through the first defrost circuit 132. The refrigerant can be in the form of a heated gas. The refrigerant flows through the first defrost circuit 132, which is routed through the second evaporator 118. In this manner, the refrigerant, which can be a heated discharge gas discharged from the first compressor 110, is routed into the second evaporator 118, causing any accumulated frost or ice to melt and be drained away. The refrigerant then continues through the first defrost circuit 132 and into the first condenser 108, the first evaporator 112, and back into the first compressor 110 where the defrost cycle continues. The second mode can terminate based on a timed duration or based on a measured increase in the second evaporator's 118 temperature as measured by a sensor in the second evaporator 118. In certain embodiments, the controller 120 can be configured to switch the refrigeration system 100 back to the first mode. In other embodiments, the controller can be configured to switch the refrigeration system 100 to a second mode in which the first evaporator 112 is defrosted as described above.

Figure 3:
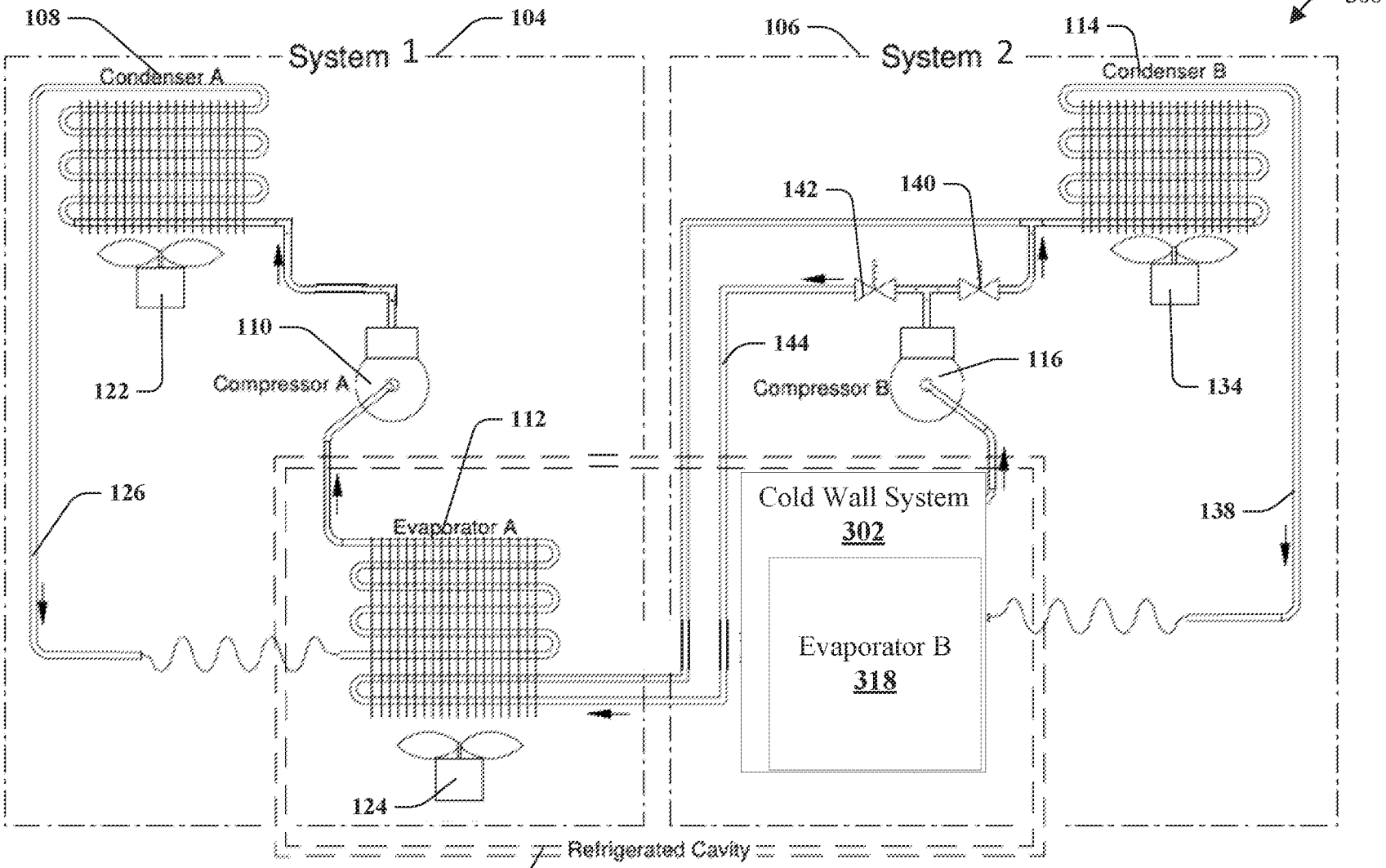
FIG. 3 is an illustration of the internal components of an exemplary refrigeration system.

Turning now to FIG. 3, in an embodiment of a refrigeration system 300, the first compression system 104 can include the first condenser 108, the first compressor 110, and the first evaporator coil 112. The second compression system 106 can include the second condenser 114, the second compressor 116, and a cold wall system 302 including a cold wall or eutectic plate evaporator 318. The first compressor 110 can run the first evaporator coil 112, while the second compressor 116 can run the cold wall system 302 that includes eutectic plates, a eutectic bank, or a copper cold wall, among others. In certain embodiments, the cold wall system 302 can have an evaporator 318. A benefit of the cold wall system (e.g. eutectic plate) is to store energy at low-use times of a "working freezer", such as overnight, to be available for use during peak or working time when the freezer is at peak load. In certain "hard freeze" freezers that are manufactured for the fast freezing of ice cream or other foods that need to be quickly frozen, by employing a cold wall system 302 as the second evaporator, the cooling capacity of the freezer is significantly increased during the working cycle of the freezer. When the freezer requires defrosting, which can be, for example, three to four times per day for heavy use, with two or three of these defrosts occurring during non-peak use times, the energy used for defrosting the first evaporator 112 coil is also used to simultaneously store energy in the cold wall system 302 for use during peak demand.

When the first evaporator coil 112 needs to be defrosted, the second compressor 116 is configured to continue running as part of the defrost cycle to defrost the first evaporator coil 112. While defrosting the first evaporator coil 112, the second compressor 116 is also operating to store the cold energy from the defrosting process in the cold wall system 302 that can include eutectic plates, a eutectic bank, or copper cold wall, among others. Even when the refrigerated cavity 102 is at its desired temperature, the cold energy is stored in the cold wall system 302 for later use. The cold wall system can use the stored cold energy to cool the refrigerated cavity 102 when necessary, for example, to achieve a temperature set point, and allow the first compressor 110 and/or the second compressor 116 to remain off for a longer time, thus conserving energy. In certain embodiments, the cold wall system 302 can defrost by sublimation of the frost on the cold wall to the second evaporator coil 118. By properly sizing the first evaporator 112 and the cold wall/eutectic storage evaporator 318, the system 300 can fully defrost the cold wall system 302 via sublimation of the frost off the cold wall/eutectic evaporator 318, thus eliminating the need for manually defrosting the cold wall/eutectic evaporator 318. A benefit of such a system is that the heat energy needed to defrost the first evaporator 112 coil of the first compression system 104 is used to power the second compressor 116 to help maintain the refrigerated cavity's 102 temperature or to store thermal energy in the cold wall system 302 for use later to maintain refrigerated cavity 102 temperature.

Figure 4:
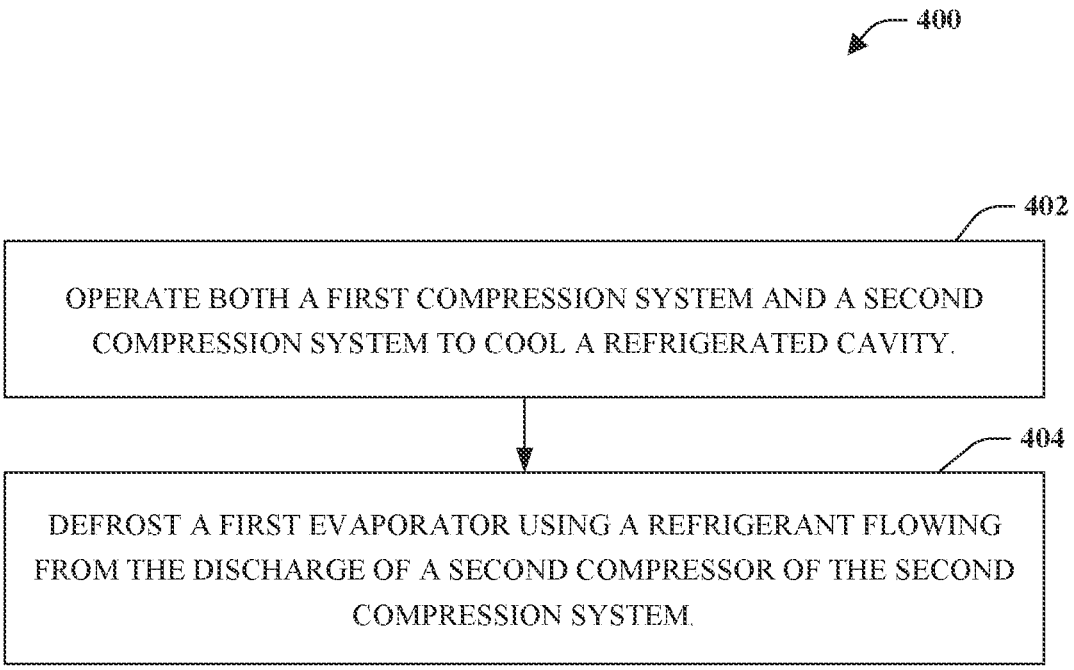
FIG. 4 is a flow chart depicting a method of operating the refrigeration system.

Turning now to FIG. 4, a method 400 of operating a refrigeration system 100, 300 is shown. At reference numeral 402, the first compression system 104 and the second compression system 106 are operated to cool a refrigerated cavity 102. At reference numeral 404, the refrigeration system 100, 300 defrosts a first evaporator 112 using a refrigerant flowing from the discharge of the second compressor 116 of the second compression system 106.

Figure 5:
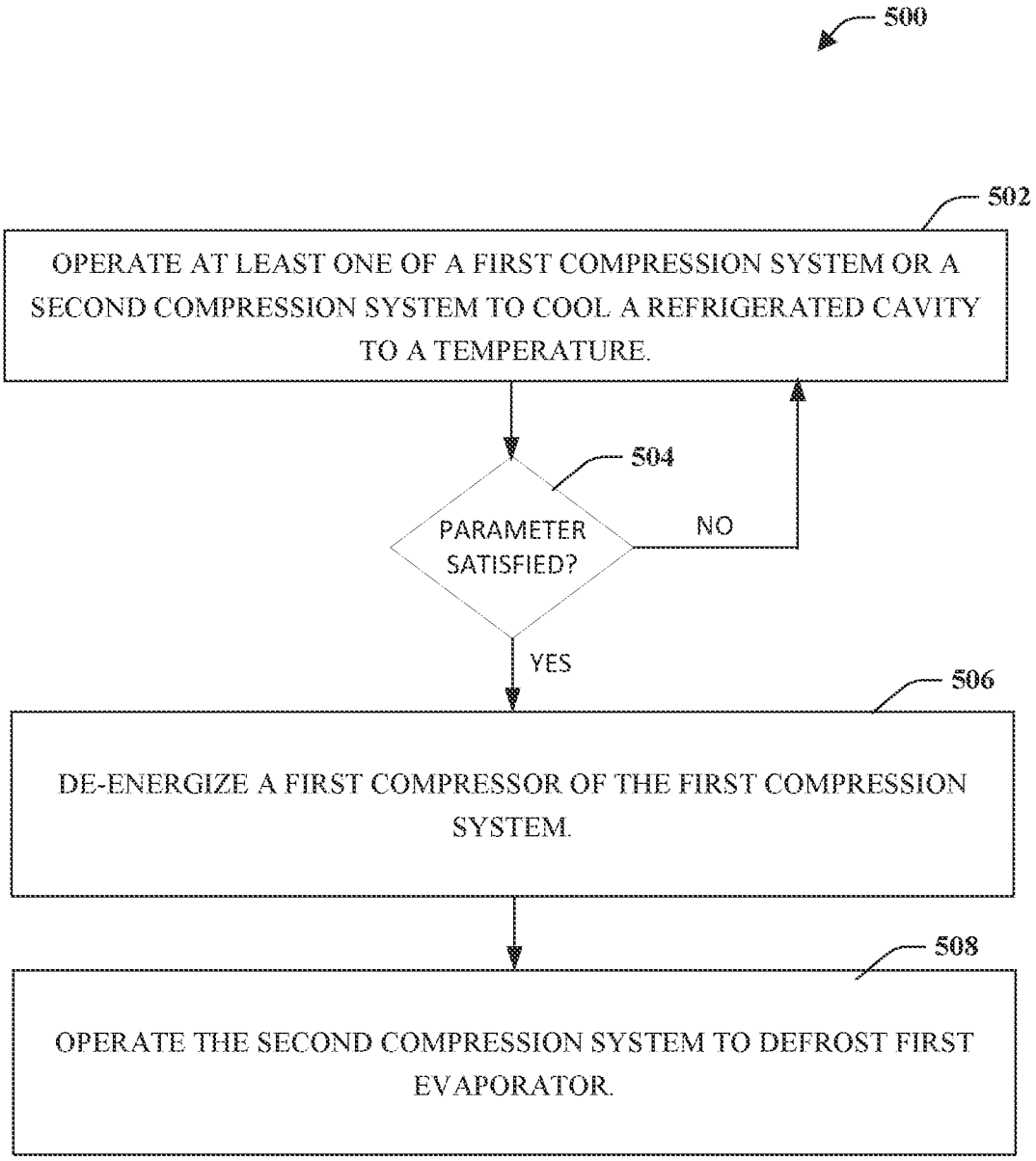
FIG. 5 is a flow chart depicting a method of operating the refrigeration system.

Turning now to FIG. 5, another method 500 of operating a refrigeration system 100, 300 is shown. At reference numeral 502, at least one of the first compression system 104 or the second compression system 106 is operated to cool a refrigerated cavity 102 to a temperature set point. When the refrigerated cavity 102 reaches the temperature set point, the controller 120 can de-energize the first compression system 104 and the second compression system 106 until further cooling is needed. At reference numeral 504, the controller 120 determines whether a parameter is satisfied. For example, the controller 120 can determine whether a period of time has elapsed, whether a temperature of the first evaporator 112 has been reached, whether there is a detected presence of frost or ice on the first evaporator 112, or whether a temperature within the refrigerated cavity 102 has been reached. If the parameter has not been satisfied, the controller 120 continues to operate the at least one of the first compression system 104 or the second compression system 106 to cool the refrigerated cavity 102 to reach the temperature set point. It should be appreciated that the at least one of the first compression system 104 and the second compression system 106 may be cycled on and off while operating in the first mode depending on the temperature of the refrigerated cavity 102 as compared to the temperature set point.

If the parameter has been satisfied, the method proceeds to reference numeral 506. At reference numeral 506, the first compressor 110 of the first compression system 104 is de-energized in response to determining that the parameter has been satisfied. At reference numeral 508, the second compression system 106 is operated to defrost the first evaporator 112 of the first compression system 104 by discharging a refrigerant from the second compressor 116 of the second compression system 106 through the first evaporator 112. Operating the second compression system 106 to defrost the first evaporator 112 can include energizing the second compressor 116 (e.g. turning on the second compressor 116 or maintaining the second compressor 116 in an energized state if already running), closing the second refrigerant valve 140, and opening the second defrost valve 142 to create a refrigerant flow path from the second compressor 116 through the first evaporator 112. In certain embodiments, the method 500 can further include storing cold energy from the second compression system 106 in a cold wall system 302 while operating the second compression system 106 to defrost the first evaporator 112. The coldness that the refrigerant acquires by flowing through the iced/frosted first evaporator 112 is transferred to the cold wall system 302 and stored therein. The coldness stored within the cold wall system 302 can then be transferred into the refrigerated cavity 102 at a later time when needed to cool the refrigerated cavity 102 to a predefined temperature.

Figure 6:
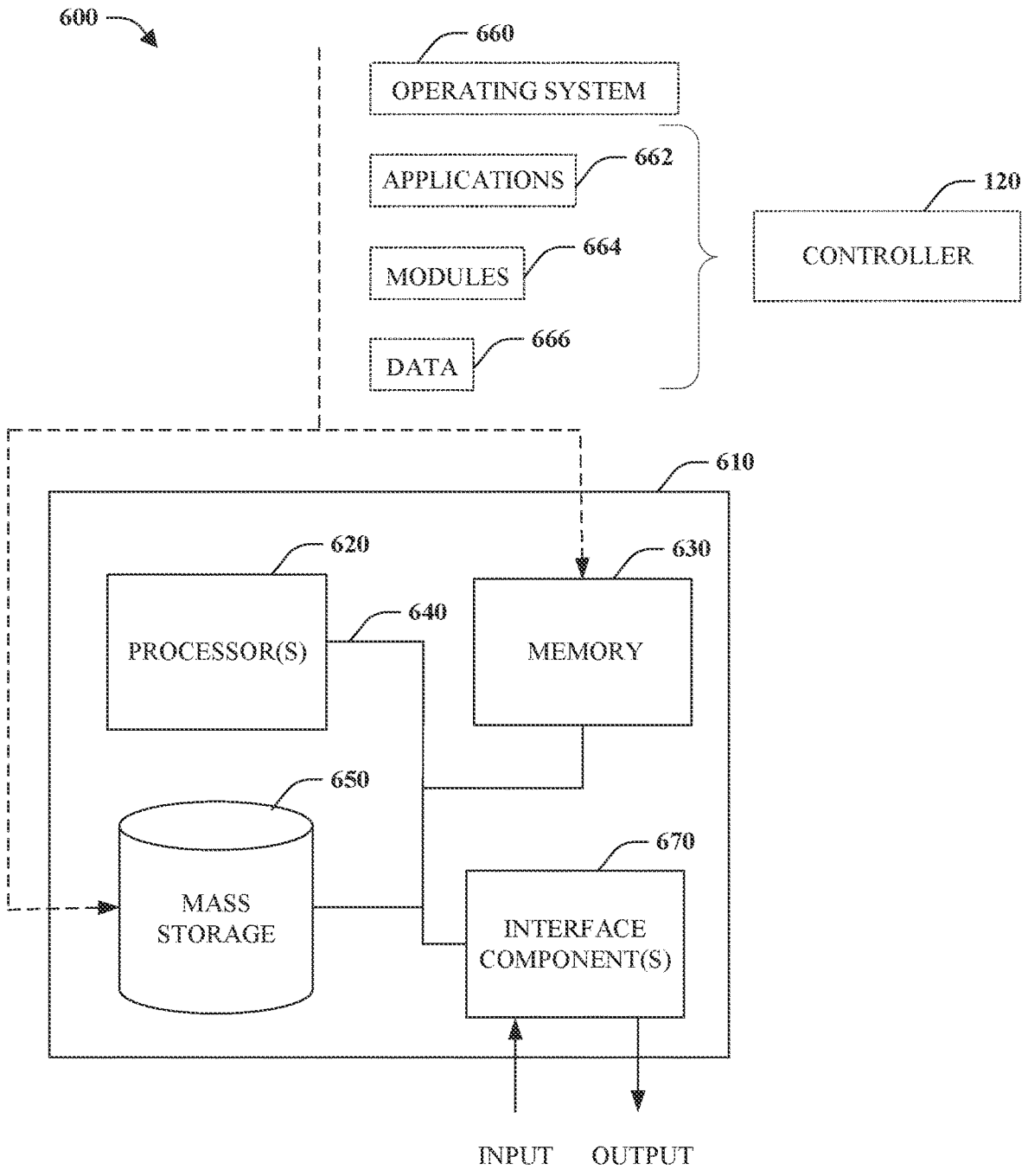
FIG. 6 is a schematic block diagram illustrating a suitable operating environment for aspects of the subject innovation.

In order to provide a context for the claimed subject matter, FIG. 6 as well as the following discussion are intended to provide a brief, general description of a suitable environment in which various aspects of the subject matter can be implemented. The suitable environment, however, is only an example and is not intended to suggest any limitation as to scope of use or functionality.

While the above disclosed system and methods can be described in the general context of computer-executable instructions of a program that runs on one or more computers, those skilled in the art will recognize that aspects can also be implemented in combination with other program modules or the like. Generally, program modules include routines, programs, components, data structures, among other things that perform particular tasks and/or implement particular abstract data types. Moreover, those skilled in the art will appreciate that the above systems and methods can be practiced with various computer system configurations, including single-processor, multi-processor or multi-core processor computer systems, mini-computing devices, mainframe computers, as well as personal computers, hand-held computing devices (e.g., personal digital assistant (PDA), portable gaming device, smartphone, tablet, Wi-Fi device, laptop, phone, among others), microprocessor-based or programmable consumer or industrial electronics, and the like. Aspects can also be practiced in distributed computing environments where tasks are performed by remote processing devices that are linked through a communications network. However, some, if not all aspects of the claimed subject matter can be practiced on stand-alone computers. In a distributed computing environment, program modules may be located in one or both of local and remote memory storage devices.

With reference to FIG. 6, illustrated is an example general-purpose computer 610 or computing device (e.g., desktop, laptop, server, hand-held, programmable consumer or industrial electronics, set-top box, game system . . . ). The computer 610 includes one or more processor(s) 620, memory 630, system bus 640, mass storage 650, and one or more interface components 670. The system bus 640 communicatively couples at least the above system components. However, it is to be appreciated that in its simplest form the computer 610 can include one or more processors 620 coupled to memory 630 that execute various computer executable actions, instructions, and or components stored in memory 630.

The processor(s) 620 can be implemented with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but in the alternative, the processor may be any processor, controller, microcontroller, or state machine. The processor(s) 620 may also be implemented as a combination of computing devices, for example a combination of a DSP and a microprocessor, a plurality of microprocessors, multi-core processors, one or more microprocessors in conjunction with a DSP core, or any other such configuration.

The computer 610 can include or otherwise interact with a variety of computer-readable media to facilitate control of the computer 610 to implement one or more aspects of the claimed subject matter. The computer-readable media can be any available media that can be accessed by the computer 610 and includes volatile and nonvolatile media, and removable and non-removable media. By way of example, and not limitation, computer-readable media may comprise computer storage media and communication media.

Computer storage media includes volatile and nonvolatile, removable and non-removable media implemented in any method or technology for storage of information such as computer-readable instructions, data structures, program modules, or other data. Computer storage media includes, but is not limited to memory devices (e.g., random access memory (RAM), read-only memory (ROM), electrically erasable programmable read-only memory (EEPROM) . . . ), magnetic storage devices (e.g., hard disk, floppy disk, cassettes, tape . . . ), optical disks (e.g., compact disk (CD), digital versatile disk (DVD) . . . ), and solid state devices (e.g., solid state drive (SSD), flash memory drive (e.g., card, stick, key drive . . . ) . . . ), or any other medium which can be used to store the desired information and which can be accessed by the computer 610.

Communication media typically embodies computer-readable instructions, data structures, program modules, or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above should also be included within the scope of computer-readable media.

Memory 630 and mass storage 650 are examples of computer-readable storage media. Depending on the exact configuration and type of computing device, memory 630 may be volatile (e.g., RAM), non-volatile (e.g., ROM, flash memory . . . ) or some combination of the two. By way of example, the basic input/output system (BIOS), including basic routines to transfer information between elements within the computer 610, such as during start-up, can be stored in nonvolatile memory, while volatile memory can act as external cache memory to facilitate processing by the processor(s) 620, among other things.

Mass storage 650 includes removable/non-removable, volatile/non-volatile computer storage media for storage of large amounts of data relative to the memory 630. For example, mass storage 650 includes, but is not limited to, one or more devices such as a magnetic or optical disk drive, floppy disk drive, flash memory, solid-state drive, or memory stick.

Memory 630 and mass storage 650 can include, or have stored therein, operating system 660, one or more applications 662, one or more program modules 664, and data 666. The operating system 660 acts to control and allocate resources of the computer 610. Applications 662 include one or both of system and application software and can exploit management of resources by the operating system 660 through program modules 664 and data 666 stored in memory 530 and/or mass storage 650 to perform one or more actions. Accordingly, applications 662 can turn a general-purpose computer 610 into a specialized machine in accordance with the logic provided thereby.

All or portions of the claimed subject matter can be implemented using standard programming and/or engineering techniques to produce software, firmware, hardware, or any combination thereof to control a computer to realize the disclosed functionality. By way of example and not limitation, the controller 120 (or portions thereof) can be, or form part, of an application 662, and include one or more modules 664 and data 666 stored in memory and/or mass storage 650 whose functionality can be realized when executed by one or more processor(s) 620. Moreover, it is to be appreciated that the software, firmware, or combination thereof to perform the functionality of the described components herein can be downloaded, installed, or a combination thereof from any host. For instance, the host can be an online store, a website, an IP address, an application store, a network, a storage medium, a portable hard disk, a server, or the Internet.

In accordance with one particular embodiment, the processor(s) 620 can correspond to a system on a chip (SOC) or like architecture including, or in other words integrating, both hardware and software on a single integrated circuit substrate. Here, the processor(s) 620 can include one or more processors as well as memory at least similar to processor(s) 620 and memory 630, among other things. Conventional processors include a minimal amount of hardware and software and rely extensively on external hardware and software. By contrast, an SOC implementation of processor is more powerful, as it embeds hardware and software therein that enable particular functionality with minimal or no reliance on external hardware and software. For example, the controller 120 (or portions thereof) can be embedded within hardware in a SOC architecture.

The computer 610 also includes one or more interface components 670 that are communicatively coupled to the system bus 640 and facilitate interaction with the computer 610. By way of example, the interface component 670 can be a port (e.g. serial, parallel, PCMCIA, USB, FireWire . . . ) or an interface card (e.g., sound, video . . . ) or the like. In one example implementation, the interface component 670 can be embodied as a user input/output interface to enable a user to enter commands and information into the computer 610 through one or more input devices (e.g., pointing device such as a mouse, trackball, stylus, touch pad, keyboard, microphone, joystick, game pad, satellite dish, scanner, camera, other computer . . . ). In another example implementation, the interface component 670 can be embodied as an output peripheral interface to source output to displays (e.g., CRT, LCD, plasma . . . ), speakers, printers, and/or other computers, among other things. Still further yet, the interface component 670 can be embodied as a network interface to enable communication with other computing devices (not shown), such as over a wired or wireless communications link.

In the specification and claims, reference will be made to a number of terms that have the following meanings. The singular forms "a", "an" and "the" include plural referents unless the context clearly dictates otherwise. Approximating language, as used herein throughout the specification and claims, may be applied to modify a quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Moreover, unless specifically stated otherwise, a use of the terms "first," "second," etc., do not denote an order or importance, but rather the terms "first," "second," etc., are used to distinguish one element from another.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

The word "exemplary" or various forms thereof are used herein to mean serving as an example, instance, or illustration. Any aspect or design described herein as "exemplary" is not necessarily to be construed as preferred or advantageous over other aspects or designs. Furthermore, examples are provided solely for purposes of clarity and understanding and are not meant to limit or restrict the claimed subject matter or relevant portions of this disclosure in any manner. It is to be appreciated a myriad of additional or alternate examples of varying scope could have been presented, but have been omitted for purposes of brevity.

Furthermore, to the extent that the terms "includes," "contains," "has," "having" or variations in form thereof are used in either the detailed description or the claims, such terms are intended to be inclusive in a manner similar to the term "comprising" as "comprising" is interpreted when employed as a transitional word in a claim.

This written description uses examples to disclose the invention, including the best mode, and also to enable one of ordinary skill in the art to practice the invention, including making and using a devices or systems and performing incorporated methods. The patentable scope of the invention is defined by the claims, and may include other examples that occur to one of ordinary skill in the art. Such other examples are intended to be within the scope of the claims if they have structural elements that do not differentiate from the literal language of the claims, or if they include equivalent structural elements with insubstantial differences from the literal language of the claims.

What is claimed is:

1. A refrigeration system comprising:

a refrigerated cavity;

a first compression system comprising a first compressor, and a first evaporator;

a second compression system comprising a second compressor; and a controller configured to:

operate the refrigeration system in a first mode in which at least one of the first compression system or the second compression system operates to cool the refrigerated cavity to a temperature;

selectively operate the refrigeration system in a second mode in which the second compression system operates to discharge a refrigerant from the second compressor, wherein the refrigerant is routed through the first evaporator to defrost the first evaporator;

switch the refrigeration system between the first mode and the second mode based upon a parameter;

a defrost circuit;

a refrigerant tubing circuit;

a defrost valve downstream from the second compressor, wherein the defrost valve is configured to selectively provide a refrigerant flow path through the defrost circuit from the second compressor through the first evaporator;

a refrigerant valve downstream from the second compressor, wherein the refrigerant valve is configured to selectively provide a refrigerant flow path through the refrigerant tubing circuit from the second compressor through a condenser of the second compression system; and where the controller is configured to, during the second mode, de-energize the first compressor, energize the second compressor, close the refrigerant valve, and open the defrost valve.

2. The refrigeration system of claim 1, wherein the second compression system further comprises a cold wall system, and the controller is configured to operate the second compression system to defrost the first evaporator while storing cold energy in the cold wall system during the second mode.

3. The refrigeration system of claim 2, wherein the cold wall system is configured to cool the refrigerated cavity to the temperature during the first mode.

4. The refrigeration system of claim 2, wherein the cold wall system includes at least one eutectic plate.

5. The refrigeration system of claim 2, wherein the cold wall system includes a copper cold wall.

6. The refrigeration system of claim 1, wherein the parameter is a period of time.

7. The refrigeration system of claim 1, wherein the parameter is one of a temperature of the first evaporator or a temperature of a second evaporator included with the second compression system.

8. The refrigeration system of claim 1, wherein the parameter is a detected presence of frost or ice on the first evaporator or a second evaporator included with the second compression system.

9. The refrigeration system of claim 1, wherein the parameter is a temperature within the refrigerated cavity.

10. The refrigeration system of claim 1, wherein each of the first compression system and the second compression system include R-290 refrigerant.

11. The refrigeration system of claim 1, wherein the controller is configured to, during the first mode, operate both the first compression system and the second compression system to cool the refrigerated cavity to the temperature.

12. A method of operating a refrigeration system, comprising:

operating at least one of a first compression system or a second compression system to cool a refrigerated cavity to a temperature;

determining that a parameter has been satisfied;

de-energizing, in response to determining that the parameter has been satisfied, a first compressor of the first compression system; and operating the second compression system to defrost a first evaporator of the first compression system by discharging a refrigerant from a second compressor of the second compression system through the first evaporator.

13. The method of claim 12, wherein operating the second compression system to defrost the first evaporator includes:

energizing the second compressor;

closing a second compression system refrigerant valve; and opening a second compression system defrost valve to create a refrigerant flow path from the second compressor through the first evaporator.

14. The method of claim 12, further comprising storing cold energy from the second compression system in a cold wall system while operating the second compression system to defrost the first evaporator.

15. The method of claim 14, further comprising transferring the cold energy from the cold wall system to the refrigerated cavity.

16. The method of claim 12, further comprising:

de-energizing the second compressor; and operating the first compression system to defrost a second evaporator of the second compression system by discharging a refrigerant from the first compressor through the second evaporator.

17. The method of claim 12, wherein the parameter is one of a period of time, a temperature of the first evaporator, a detected presence of frost or ice on the first evaporator, or a temperature within the refrigerated cavity.

18. A refrigeration system comprising:

a refrigerated cavity;

a first compression system comprising a first compressor and a first evaporator, wherein the first compression system is configured to cool the refrigerated cavity to a temperature; and a second compression system comprising a second compressor and a cold wall system configured to store coldness and to provide stored coldness to the refrigerated cavity, wherein the second compression system is further configured to store coldness in the cold wall system while defrosting the first evaporator by de-energizing the first compressor of the first compression system and discharging a refrigerant from the second compressor of the second compression system through the first evaporator via a refrigerant flow path from the second compressor to the first evaporator.

* * * * *